US009828718B2

(12) United States Patent
Lee et al.

(10) Patent No.: US 9,828,718 B2
(45) **Date of Patent: *Nov. 28, 2017**

(54) LAUNDRY TREATING APPARATUS AND METHOD FOR CONTROLLING THE SAME

(71) Applicant: LG ELECTRONICS INC., Seoul (KR)

(72) Inventors: Hoonbong Lee, Changwon-si (KR); Chungill Lee, Changwon-si (KR); Hansu Jung, Changwon-si (KR)

(73) Assignee: LG ELECTRONICS INC., Seoul (KR)

( * ) Notice: Subject to any disclaimer, the term of this patent is extended or adjusted under 35 U.S.C. 154(b) by 531 days.

This patent is subject to a terminal disclaimer.

(21) Appl. No.: 14/458,590

(22) Filed: Aug. 13, 2014

(65) Prior Publication Data

US 2015/0051738 A1 Feb. 19, 2015

(30) Foreign Application Priority Data

Aug. 14, 2013 (KR) ..... 10-2013-0096744

(51) Int. Cl.

| | |
|---|---|
| ***G05B 13/00*** | (2006.01) |
| ***D06F 39/00*** | (2006.01) |
| ***D06F 33/02*** | (2006.01) |

(52) U.S. Cl.

CPC ..... *D06F 39/003* (2013.01); *D06F 33/02* (2013.01); *D06F 2202/10* (2013.01); (Continued)

(58) Field of Classification Search

CPC .... D06F 35/006; D06F 37/304; D06F 37/203; D06F 39/003; D06F 33/02; D06F 2202/10; D06F 2058/2861

See application file for complete search history.

(56) References Cited

U.S. PATENT DOCUMENTS

2005/0086742 A1* 4/2005 Kim ..... D06F 39/003 8/158
2006/0021392 A1 2/2006 Hosoito et al.
(Continued)

FOREIGN PATENT DOCUMENTS

CN 101591847 12/2009
EP 2 128 325 A2 12/2009
(Continued)

OTHER PUBLICATIONS

European Search Report issued in application No. 14180844.4 dated Jan. 5, 2015.

(Continued)

*Primary Examiner* — Tuan Vu
(74) *Attorney, Agent, or Firm* — Ked & Associates, LLP

(57) ABSTRACT

A method may be provided for controlling a laundry treating apparatus. A first speed rotating may control the drum to accelerate the drum to rotate at a first speed, a braking may apply a brake to stop the drum, a second speed accelerating may accelerate the drum to a second speed, a current sensing may sense a current being applied to the motor during the drum is accelerated to the second speed, and a laundry amount determining may determine a laundry amount based on the current sensed in the current sensing.

18 Claims, 8 Drawing Sheets

(52) U.S. Cl.
CPC ..... *D06F 2202/12* (2013.01); *D06F 2204/06* (2013.01); *D06F 2204/08* (2013.01)

(56) References Cited

U.S. PATENT DOCUMENTS

| | | | | |
|---|---|---|---|---|
| 2007/0145941 | A1* | 6/2007 | Asada | D06F 37/304 318/811 |
| 2008/0196172 | A1* | 8/2008 | Jeong | D06F 33/02 8/159 |
| 2008/0289118 | A1* | 11/2008 | Park | D06F 37/203 8/159 |
| 2009/0307851 | A1* | 12/2009 | Bae | D06F 35/006 8/159 |
| 2010/0031451 | A1 | 2/2010 | Bae et al. | |
| 2011/0047717 | A1* | 3/2011 | Cho | D06F 33/02 8/137 |
| 2012/0005840 | A1 | 1/2012 | Jang et al. | |
| 2012/0324654 | A1 | 12/2012 | Koo et al. | |

FOREIGN PATENT DOCUMENTS

| | | |
|---|---|---|
| KR | 10-1999-0047136 | 7/1999 |
| KR | 10-0264037 | 8/2000 |
| KR | 10-2005-0046805 | 5/2005 |
| KR | 10-2009-0122804 | 12/2009 |
| KR | 10-2011-0023061 | 3/2011 |
| KR | 10-1156710 | 6/2012 |
| WO | WO 2011/025339 A2 | 3/2011 |

OTHER PUBLICATIONS

European Search Report issued in application No. 14180846.9 dated Jan. 8, 2015.

European Search Report issued in application No. 14180844.4 dated Jan. 12, 2015.

European Search Report issued in application No. 14180846.9 dated Jan. 13, 2015.

Korean Office Action for Application 10-2013-0096744 dated Oct. 1, 2015.

Korean Office Action for Application 10-2013-0096745 dated Oct. 1, 2015.

Chinese Office Action issued in Application 2014104000008.7 dated Feb. 3, 2016 (full Chinese text).

U.S. Appl. No. 14/458,602, filed Aug. 13, 2014, Kenneth Rinehart.

* cited by examiner (a)

(b)

LAUNDRY TREATING APPARATUS AND METHOD FOR CONTROLLING THE SAME

CROSS-REFERENCE TO RELATED APPLICATION

This application claims priority under 35 U.S.C. §119 to Korean Application No. 10-2013-0096744, filed Aug. 14, 2013, the subject matter of which is hereby incorporated by reference.

BACKGROUND

1. Field

Embodiments may relate to a laundry treating apparatus and a method for controlling the same.

2. Background

In general, a laundry treating apparatus, a machine for applying physical and chemical actions to laundry or clothes to treat the same, calls a washing machine for removing dirt from the laundry, a spin-dryer for spinning a drum holding the laundry therein for extracting water from the laundry, and a dryer for applying cold or heated air to the drum for drying wet laundry, collectively.

The laundry treating apparatus may detect an amount of laundry (hereafter called a laundry amount) introduced to the drum before performing an operation, such as washing, rinsing, spinning, drying, and etc, and sets an amount of water supply, an operation course, and an operation time period according to the detected laundry amount.

The laundry amount detection may use a principle in which a load on a motor varies with the laundry amount and a current applied to the motor for rotating the drum varies with the load. However, since the load on the motor varies, not only with the load on the motor, but also with a state of clothes in the drum, there has been a problem in that a detected laundry amount shows a variation.

SUMMARY OF THE INVENTION

Embodiments may provide a laundry treating apparatus in which dispersion of the clothes caused by clothes positioned to one side (i.e., an influence of eccentricity) at the time of laundry amount measurement is improved for making more accurate laundry amount determination, and a method for controlling the same.

Embodiments may provide a method for controlling a laundry treating apparatus having a drum rotatably provided for holding laundry, and a motor for rotating the drum. The method may include a first speed rotating for controlling the drum to accelerate the drum to rotate at a first speed, a braking for applying a brake to stop the drum, a second speed accelerating for accelerating the drum to a second speed, a first current sensing for sensing a current applied to the motor at a first current sensing section between a first rotation angle and a second rotation angle during the drum is accelerated to the second speed, a second current sensing for sensing the current applied to the motor at a second current sensing section after the first current sensing section during the drum is accelerated to the second speed, and a laundry amount determining for determining a laundry amount based on the current sensed in the first current sensing and the current sensed at the second current sensing.

Embodiments may provide a laundry treating apparatus including a drum rotatably provided for holding laundry, a motor for rotating the drum, a motor control unit for applying a brake to stop the drum after controlling the motor to rotate at a first speed, and controlling the motor to make the drum to accelerate to a second speed again, a current sensing unit for sensing a current applied to the motor during the motor is controlled by the motor control unit, and a laundry amount sensing unit for determining a laundry amount based on a current sensed at the current sensing unit at a first current sensing section between a first rotation angle and a second rotation angle during the drum is accelerated to the second speed and a current sensed at a second current sensing section after the first current sensing section.

The laundry treating apparatus and the method for controlling the same may have an effect of determining a laundry amount by reflecting an influence from eccentricity.

The laundry treating apparatus and the method for controlling the same may have an effect of sensing the laundry amount accurately even in a state the clothes are not distributed uniformly.

BRIEF DESCRIPTION OF THE DRAWINGS

Arrangements and embodiments may be described in detail with reference to the following drawings in which like reference numerals refer to like elements and wherein.

DETAILED DESCRIPTION

Advantages, features and methods for achieving those of embodiments may become apparent upon referring to embodiments described below in detail together with attached drawings. However, embodiments are not limited to the embodiments disclosed hereinafter, but may be embodied in different modes. The embodiments are provided for perfection of disclosure and informing a scope to persons skilled in this field of art. The same reference numbers may refer to the same elements throughout the specification.

Figure 1:
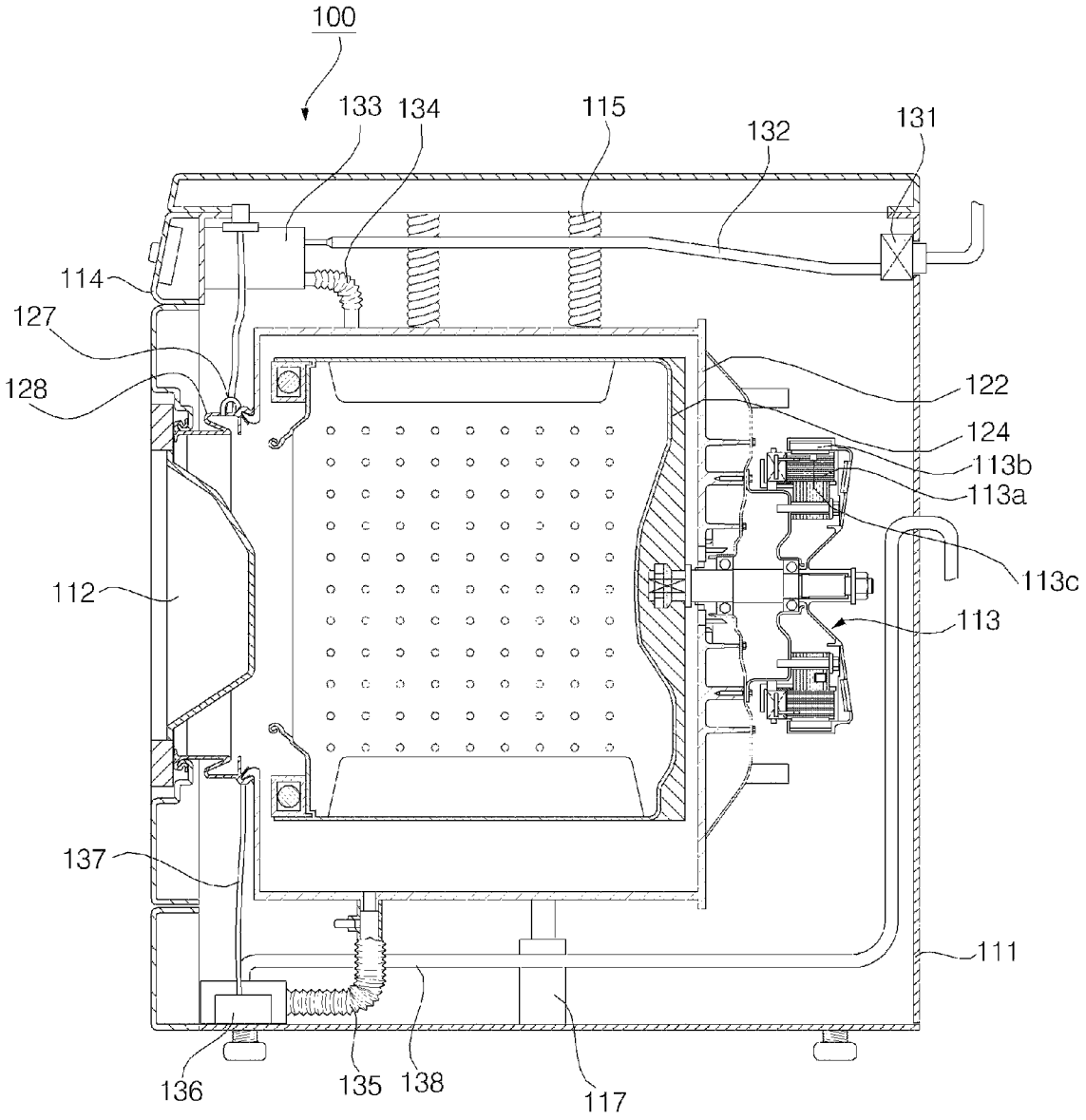
FIG. 1 is a sectional view illustrating a laundry treating apparatus in accordance with an example embodiment.
Figure 2:
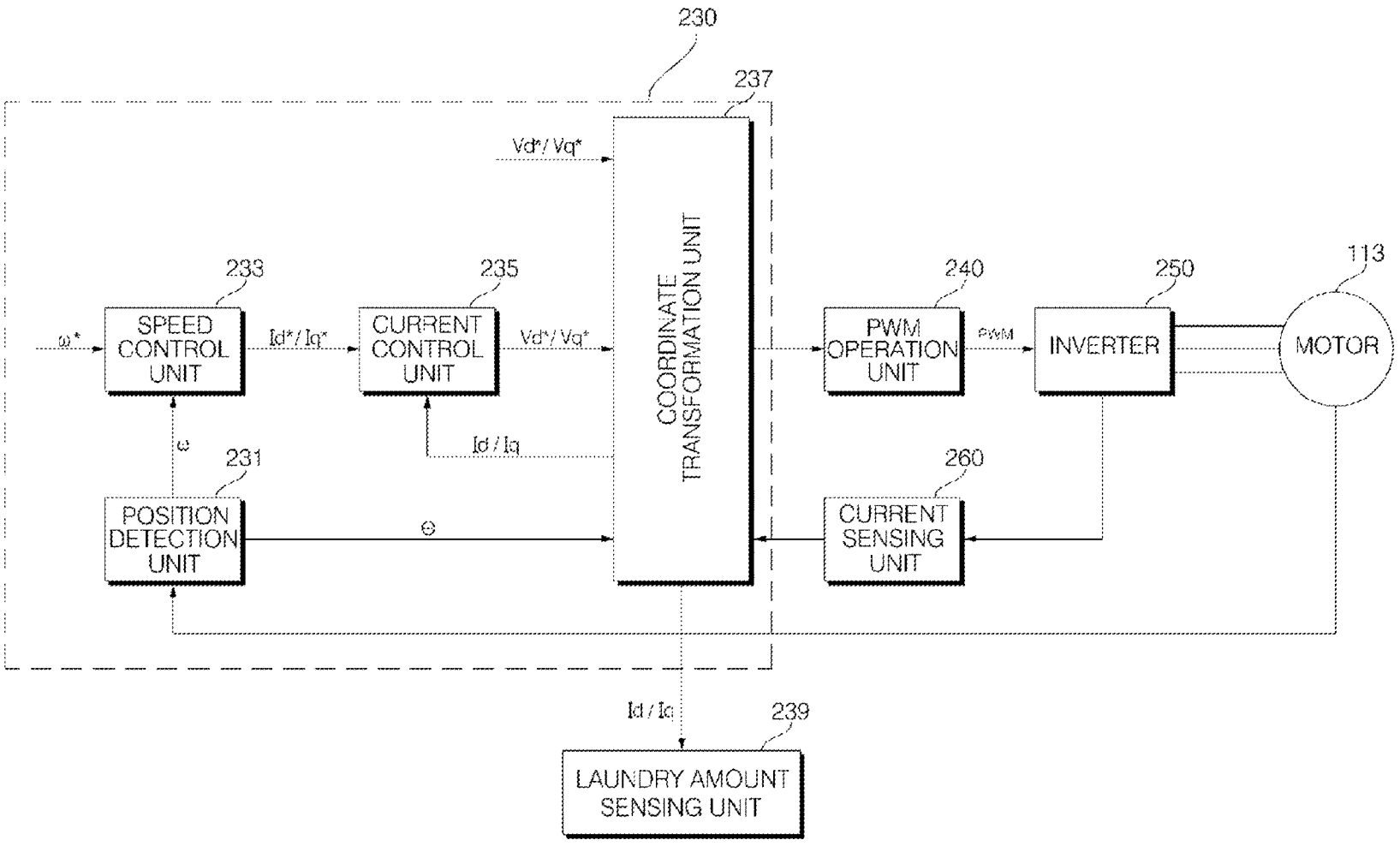
FIG. 2 is a block diagram illustrating control relations among major elements of the laundry treating apparatus in FIG. 1.

FIG. 1 is a sectional view illustrating a laundry treating apparatus in accordance with an example embodiment. FIG. 2 is a block diagram illustrating control relations among major elements of the laundry treating apparatus in FIG. 1. Other embodiments and configurations may also be provided.

Referring to FIG. 1, a laundry treating apparatus 100 in accordance with an example embodiment may include a casing 111 having a clothes introduction opening 111*a* formed therein, a door 112 for opening/closing the clothes introduction opening 111*a*, a tub 122 arranged in the casing 111, a drum 124 rotatably provided in the tub 122 for holding clothes introduced thereto through the clothes introduction opening 111*a*, a motor 113 for rotating the drum 124, a detergent box 133 for holding detergent, and a control panel 114.

The cabinet 111 may have the door 112 rotatably coupled thereto for opening/closing the clothes introduction opening 111*a*. The cabinet 111 may have the control panel 114 provided thereto. The cabinet 111 may have the detergent box 133 drawably provided thereto.

The tub 122 may be arranged in the cabinet 111 to be able to be buffered with a spring 115 and a damper 117. The tub 122 may hold washing water. The tub 122 may be arranged to an outside of the drum 124 to surround the drum 124.

The motor 113 may generate a torque for rotating the drum 124. The motor 113 may rotate in a regular direction or a reverse direction, for rotating the drum 124 in different speeds or directions.

The drum 124 may rotate with the clothes held therein. The drum 124 may be arranged in the tub 122. The drum 124 may be formed in a rotatable cylindrical shape. The drum 124 may have a plurality of pass through holes for passing the washing water. The drum 124 may rotate upon having torque of the motor 113 forwarded thereto.

A gasket 128 may seal between the tub 122 and the cabinet 111. The gasket 128 may be arranged between the inlet of the tub 122 and the clothes introduction opening 111*a*. The gasket 128 may attenuate an impact forwarded to the door 112 when the drum 124 rotates as well as prevent the washing water from leaking to an outside of the tub 122. The gasket 128 may have a circulating nozzle 127 provided thereto for introduction of the washing water to an inside of the drum 124.

The detergent box 133 may hold detergent, such as washing detergent, fiber softener, or bleaching agent. The detergent box 133 may be drawably provided to a front side of the cabinet 111. The detergent in the detergent box 133 may be introduced to the tub 122 mixed with the washing water when the washing water is supplied to the tub 122.

Provided to an inside of the cabinet 111, there may be a water supply valve 131 for controlling introduction of the washing water from an external water source, a water supply passage 132 for flow of the washing water being introduced to the water supply valve to the detergent box 133, and a water supply pipe 134 for introduction of the washing water having the detergent mixed therewith at the detergent box 133 to the tub 122.

Provided to the inside of the cabinet 111, there may be a drain pipe 135 for draining the washing water from the tub 122, a pump 136 for draining the washing water from the tub, a circulating flow passage 137 for circulation of the washing water, a circulating nozzle 127 for introduction of the washing water to the drum 124, and a drain flow passage 138 for draining the washing water to an outside of the laundry treating apparatus. Depending on embodiments, the pump 136 may be a circulating pump and a drain pump connected to the circulating flow passage 137 and the drain flow passage 138, respectively.

The motor 113 may include a stator 113*a* having coils wound thereon, a rotor 113*b* for rotating owing to electromagnetic reaction with the coil, and a hall element 113*c* for sensing a position of the rotor 113*b*.

Referring to FIG. 2, the laundry treating apparatus may include a motor control unit 230, a PWM operation unit 240, an inverter 250, and a current sensing unit 260.

The motor control unit 230 may control power to be applied to the motor 113. The motor control unit 230 may include a position detection unit 231, a speed control unit 233, a current control unit 235, and a coordinate transformation unit 237.

The motor 113 may include the hall element 113*c* for detecting a position of the rotor. The hall element may include an N type semiconductor for measuring strength of a magnetic field by using a hall effect. For an example, if the hall element has a current $I_H$ flowing thereto and magnetic flux B applied to a surface of the hall element perpendicular to a direction of the current, a voltage $V_H$ may generate in a direction perpendicular to the magnetic flux B proportional to the current $I_H$ and a magnitude of the magnetic flux B. Since the hall element can detect N, S poles and magnitudes thereof from the voltage $V_H$ generated thus, the hall element can detect a position of the rotor that is a permanent magnet of a PMSM (Permanent Magnet Synchronous Motor) or BLDC (Brushless DC electric Motor). Moreover, since the hall element 113*c* generates the voltage $V_H$ proportional to the magnitude of the magnetic flux B, enabling to detect current intensity that generates the magnetic flux, the hall element may also be used as a current sensor.

The position detection unit 231 may detect a position of the drum 124 based on the position of the rotor 113*b* sensed by the hall element 113*c*. The position detection unit 231 may also detect a rotation speed of the drum 124 based on the position of the rotor 113*b* or the drum 124 detected thus. The position detection unit 231 may detect the rotation speed of the motor 113 by using the current that the current sensing unit 260 senses.

The position of the rotor 113*b* detected with the hall element 113*c* (i.e., a rotation angle θ of the drum 124) may have a smallest unit varied with a number of the permanent magnets mounted to the rotor 113*b*. The embodiment may suggest, but is not limited to, 15° as the smallest unit of angle.

The speed control unit 233 may subject the rotation speed of the rotor 113*b* detected at the position detection unit 231 to proportional integral control PI for forwarding a command current that is to make the rotation speed ω to follow a command speed ω*. On a d-q axes rotating coordinate system having a d-axis parallel to a direction of the magnetic flux and a q-axis perpendicular to the d-axis, the command current forwarded by the speed control unit 233 may be expressed with a vector sum of a d-axis command current Id* and a q-axis command current Iq*.

The current control unit 235 subjects the present currents Id, Iq the current sensing unit 260 detects to proportional integral control PI to make the present currents Id, Iq to follow the command currents Id*, Iq* to generate a d-axis command voltage Vd*, and a q-axis command voltage Vq*.

The coordinate transformation unit 237 may transform the d-q axes rotating coordinate system to a uvw fixed coordinate system and vice versa. The coordinate transformation unit 237 may transform the command voltage Vd*/Vq* applied thereto in the d-q axes rotating coordinate system to three phase command voltages. The coordinate transformation unit 237 may transform the present current in the fixed coordinate system (the current sensing unit 260 senses to be described later) to the d-q axes rotating coordinate system. The rotating coordinate system may be a rotor reference frame rotating in synchronization with the speed of the rotor 113*b*. The coordinate transformation unit 237 may transform a coordinate based on a position θ of the drum 124 that the position detection unit 231 detects.

The PWM (Pulse Width Modulation) operation unit 240 has a signal of the uvw fixed coordinate system applied thereto from the motor control unit 230 for generating a PWM signal.

The inverter 250 is a converter for generating AC power of a variable voltage and a variable frequency from fixed or variable DC power. The inverter 250 receives a PWM signal from a PWM operation unit 240 for controlling power to be directly applied to the motor 133. The inverter 250 may control, not only a frequency of AC output power, but also an output voltage of the AC output power. Depending on embodiments, the PWM operation unit 240 may be included to the inverter 250. Such an inverter may be called a PWM inverter.

The PWM operation unit 240 may generate gating pulses of each phase switch for generating a fundamental voltage having a volt-second average and a frequency the same with command voltages Vd* and Vq* with the inverter 250. Additionally, a switching pattern may be determined to minimize unnecessary harmonics and switching losses, and as PWM techniques for this, optimal/programmed PWM, carrier based PWM, space vector PWM, and so on are known well.

The laundry treating apparatus may perform operations or washing, rinsing, spinning, and drying according to setting based on the control panel 114, for performing an operation optimized to an amount of the clothes by setting detailed variables, such as a water supply amount, a rotation speed of the drum 124, a rotation pattern, an operation time period according to the amount of clothes (laundry amount) introduced to the drum 124. The laundry treating apparatus may sense the laundry amount before performing respective operations. Embodiments described hereafter describe the operations for sensing the laundry amount, wherein the laundry amount is not only sensed before performing any stroke of the washing, rinsing, spinning, and drying, but also performed in middle of progress of the stroke. The operations may be applied, not only to an example when a dry laundry amount is sensed before the water supply is made to the drum 124, but also to an example when a wet laundry amount is sensed after the water supply is made to the drum 124.

A laundry amount sensing unit 239 may determine the laundry amount based on a current. The laundry amount may be determined based on a present current Id, Iq sensed by a current sensing unit 260, and depending on embodiments, not only the present currents, but also a counter electromotive force may be taken into account, altogether.

Figure 3:
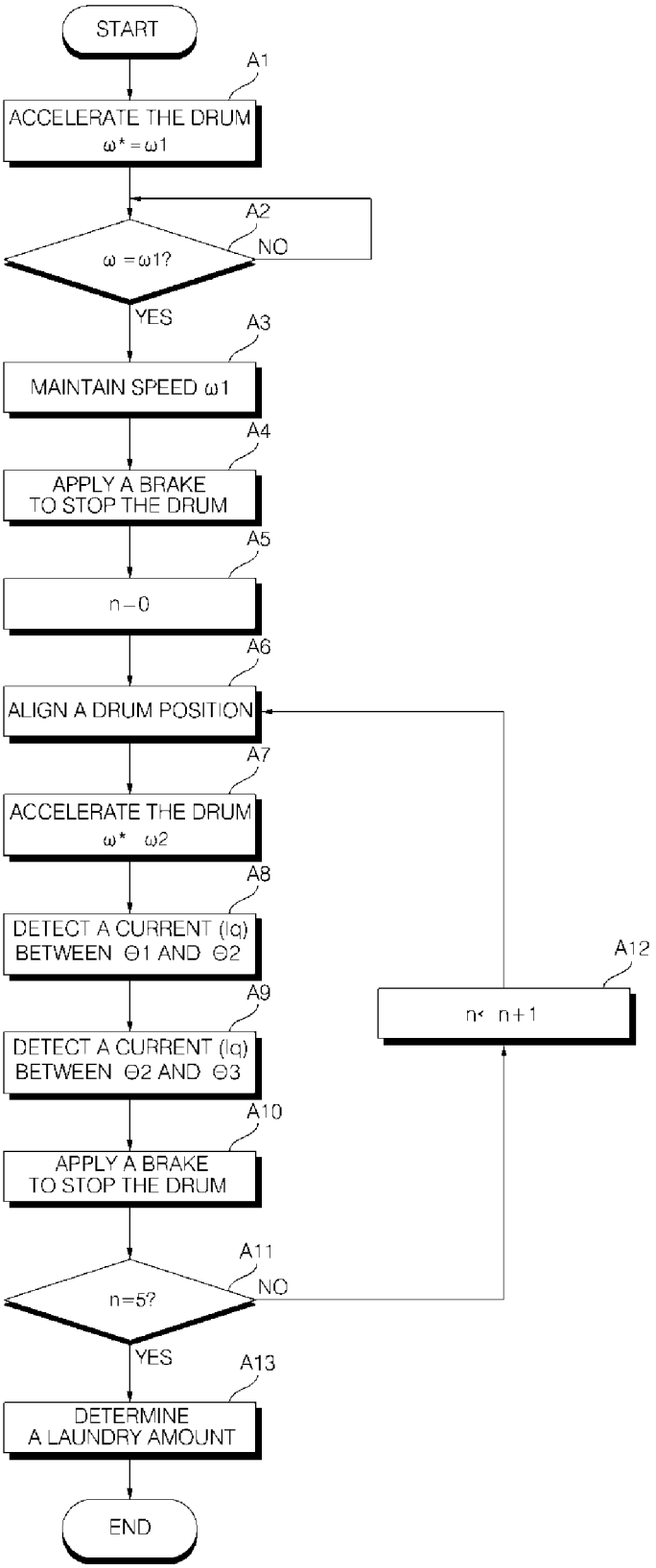
FIG. 3 is a flow chart of a method for controlling a laundry treating apparatus in accordance with an example embodiment.
Figure 4:
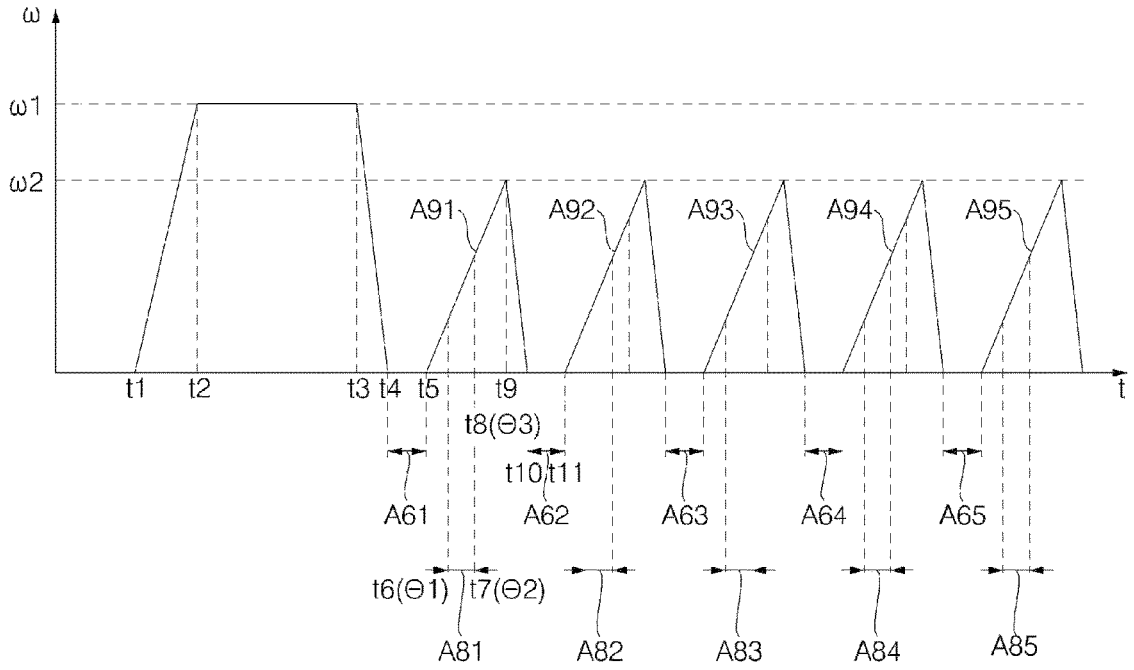
FIG. 4 is a graph illustrating time vs. rotation speed of a drum when a laundry treating apparatus is operated according to a control method in accordance with an example embodiment.
Figure 5:
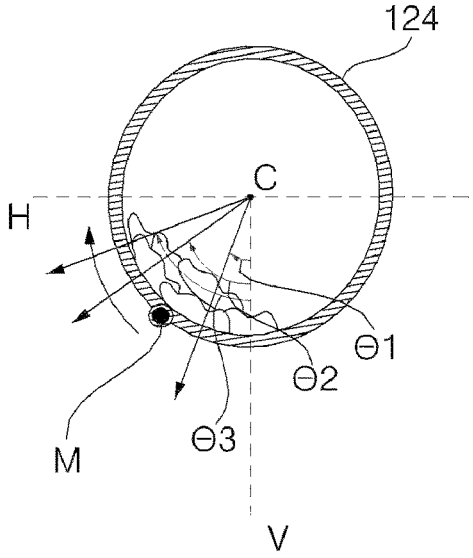
FIG. 5 is a sectional view illustrating current sensing sections.
Figure 6:
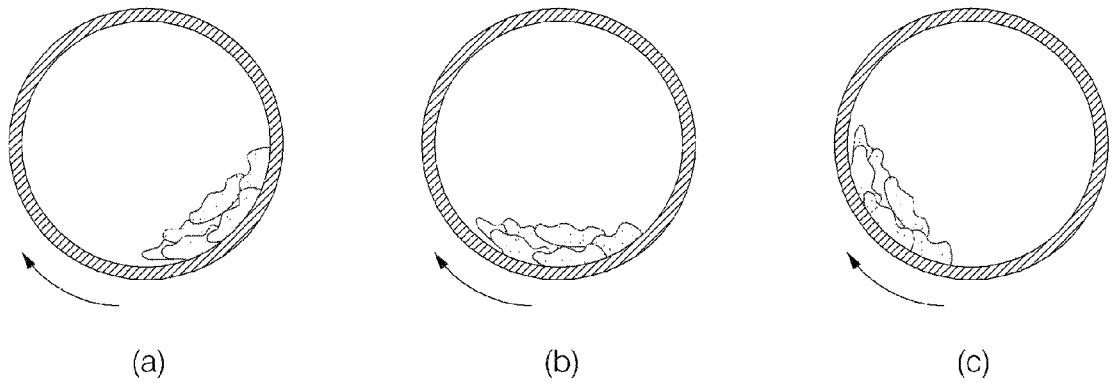
FIGS. 6A~6C are sectional views illustrating positions of eccentricity when a drum is driven, respectively.
Figure 7:
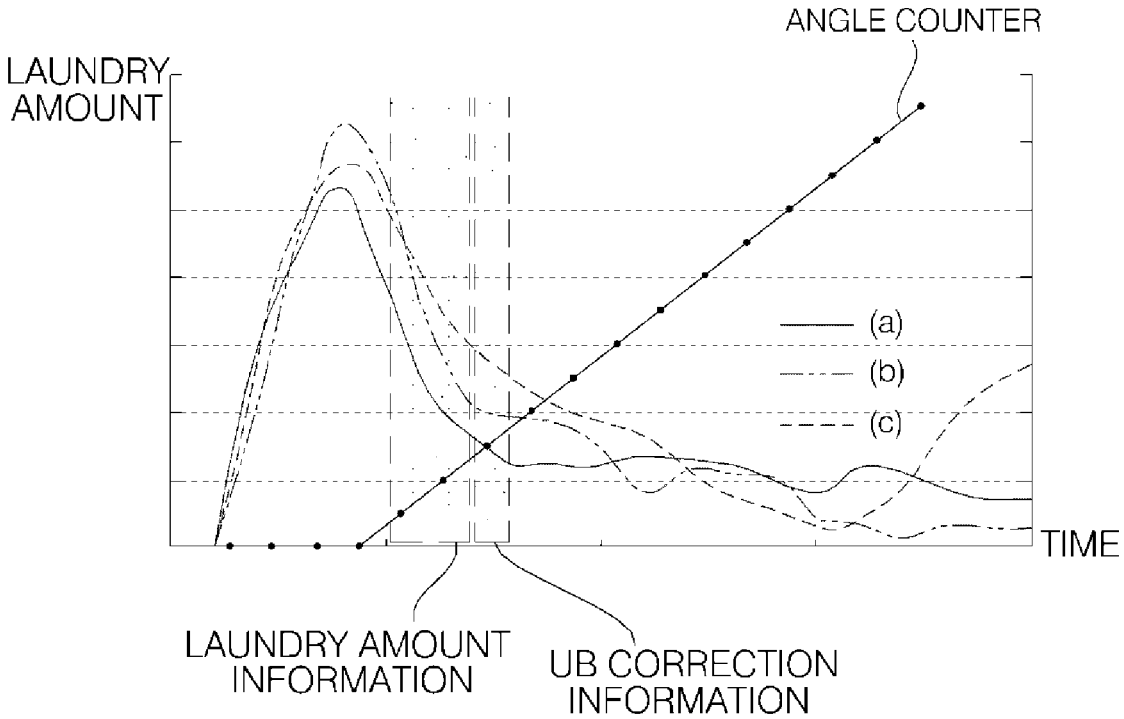
FIG. 7 is a graph illustrating comparison of dispersions of a laundry amount varied with the eccentricity positions in FIG. 6A~6C.

FIG. 3 is a flow chart of a method for controlling a laundry treating apparatus in accordance with an example embodiment. FIG. 4 is a graph illustrating time vs. rotation speed of a drum when a laundry treating apparatus is operated according to a control method in accordance with an example embodiment. FIG. 5 is a sectional view illustrating current sensing sections. FIGS. 6A-6C are sectional views illustrating positions of eccentricity when a drum is driven, respectively. FIG. 7 is a graph illustrating comparison of dispersions of a laundry amount varied with the eccentricity positions in FIGS. 6A-6C. A method for controlling a laundry treating apparatus in accordance with an example embodiment will be described with reference to FIGS. 3 to 7. Other embodiments and configurations may also be provided.

The clothes are introduced to the drum 124 and the drum 124 may be accelerated (A1, [t1, t2]). A command speed ω* applied to a speed control unit 233 is a first speed ω1, and a rotation speed co of the drum 124 may rise (or increase) following the first speed ω1. The first speed ω1 is a speed that can change a clothes state in the drum 124, required to make at least some of the clothes held in the drum 124 to move, and may be set between 46 rpm to 60 rpm, for example.

If the rotation speed co of the drum 124 sensed at a position detection unit 231 reaches the first speed ω1 (A2), the speed control unit 233 controls the drum 124 to rotate at a fixed speed of the first speed ω1 (A3, [t2, t3]) by a speed control unit 233 integral control (PI).

If a certain time period is passed from the t2 to reach the t3, a brake may be applied to the motor 113 to stop the drum 124 (A4, [t3, t4]). A braking system of the drum 124 may be regenerative braking or dynamic braking.

For counting a number of repetitions of current sensing (A8, A9) to be described later, an 'n' is set to zero (A5).

At a position aligning section [t4, t5] before the drum 124 stopped thus is accelerated again, a position of the drum 124 may be aligned (A6, A61). Magnetization of the stator 113*a* can be made to make the rotor 113*b* to be at a regular position, when a d-axis current may be output from a current control unit 235. In this process, resistance of the motor 113 and an error of voltage information may be sensed. The position alignment of the drum 124 may also be performed at a position aligning section A62, A63, A64, A65 between acceleration to a second speed ω2 (to be described below) is repeated.

When the same command speed ω* is requested, in order to make the present speed ω to follow the command speed, a torque value generated by the motor 113 is required to vary with the laundry amount. In view of the current, the current applied to the motor 113 is required to vary with the laundry amount. Accordingly, the current applied to the motor 113 may be an index that reflects the laundry amount.

Although the laundry amount may be determined based on the current detected at any section at which the rotation of the drum 124 is made, preferably, the laundry amount may be determined based on the current applied to the motor 113, which is sensed at a section at which the clothes are lifted by the rotation of the drum 124. Determination of the laundry amount may be made at the laundry amount sensing unit 239.

The current applied to the motor 113, a present current forwarded from the inverter 250, may be sensed by the current sensing unit 260. The present current value may be expressed with a d-axis present current Id and a q-axis present current Iq on a d-q rotating coordinate system. Additionally, of the d-axis present current Id and q-axis present current Iq, since a component that generates the torque for rotating the rotor 113*b* is the q-axis component mostly, the laundry amount is determined based on the q-axis present current Iq.

Additionally, although a value sensed starting from a time point the current is applied to the motor 113 for rotating the drum 124 from a stationary state may be used as the present current required for determining the laundry amount, the present current value sensed at an initial stage of the rotation of the drum 124 can not reflect the laundry amount accurately due to different reasons, such as a degree of magnetization of the stator 113*a*, a state of arrangement of the clothes in the drum 124, and etc. Consequently, the laundry amount may be determined based on the present current value sensed after the drum 124 is rotated to a certain extent from the stationary state.

Referring to FIG. 3, operations for determining the laundry amount may be described in more detail.

The drum 124 may be accelerated from a stationary state (A7, [t5, t9]). The command speed ω* applied to the speed control unit 233 is a second speed ω2, and the rotation speed ω of the drum 124 rises (or increases) following the second speed ω2. The second speed ω2 may be set lower (or less) than the first speed ω1, for an example, 46 rpm.

In this example, it is not required to accelerate the drum 124 until the drum 124 reaches the ω2 which is the command speed, without fail. That is, although FIG. 4 illustrates that braking of the drum 124 is made after the drum 124 reaches the command speed ω2 in each of the acceleration operations, this is no more than illustrative one, and it will be adequate if the drum 124 is accelerated following a predetermined command speed in the acceleration operation. The command speed in each of the acceleration operations may have the same value.

Moreover, even if a highest value of the rotation speed may not reach to the command speed ω2 depending on a drive time period of the motor 113 in the acceleration operation, even in this example, the highest value may be less than the first speed ω1.

Referring to FIG. 5, while the drum 124 is being accelerated, the present current Id/Iq is measured (A8) at the first current sensing section (A81) in which a position of the drum 124 changes from a first rotation angle θ1 to a second rotation angle θ2. As described before, the laundry amount may be determined based on the q-axis present current value Iq of the present current values.

The first current sensing section may be defined as a section from a first rotation angle θ1 to a second rotation angle θ2, and a second current sensing section may be defined as a section from a second rotation angle θ2 to a third rotation angle θ3.

In the meantime, while the drum 124 is being accelerated, the present current Id/Iq may be measured (A9) even at the second current sensing section (A91) after the first current sensing section, and the present current value measured thus may be used as information for correcting an amount of eccentricity at the time of determination of the laundry amount.

The brake may be applied to stop the drum 124 (A10, [t9, t10]).

Referring to FIGS. 6 and 7, since the drum 124 is started in a state the eccentricity is caused, the drum 124 may be accelerated to the second speed ω. FIG. 6A illustrates a case when the clothes are not at a lowest point at the time of starting of the drum 124, but move down together with the starting. In this example, the laundry amount determined based on the present current value sensed during the drum 124 rotates at the first current sensing section (A81) is illustrated in a graph (a) in FIG. 7.

FIG. 6B illustrates an example when the clothes are positioned at the lowest point when the drum 124 is started. In this example, the laundry amount determined based on the present current value sensed during the drum 124 rotates at the first current sensing section (A81) is illustrated in a graph (b) in FIG. 7.

FIG. 6C illustrates an example when the clothes are positioned, not at the lowest point, but at a position moved up along the rotation direction, when the drum 124 is started. In this case, the laundry amount determined based on the present current value sensed during the drum 124 rotates at the first current sensing section (A81) is illustrated in a graph (c) in FIG. 7.

As can be known from FIGS. 6 to 7, when the drum 124 is started, a distribution takes place in a laundry amount value depending on positions of the eccentricity. This is because a required torque for driving the drum 124 varies with the load on the drum 124, which varies with positions of the eccentricity. Consequently, it is required to reduce the distribution of the laundry amount value determined thus by removing influence from the position of the eccentricity at the time of determination of the laundry amount. The embodiment may determine the laundry amount based on the present current value sensed at the first current sensing section (A81) corrected by using the present current value sensed at the second current sensing section after the first current sensing section, for determining more accurate amount.

FIG. 5 illustrates position changes of the drum 124 according to drive of the motor 113 (i.e., changes from the first rotation angle θ1 to the second rotation angle θ2). M illustrates the lowest point of the drum 124 having an aligned position in a stationary state and may be called a reference point. FIG. 5 illustrates a state in which the reference point is moved up between the rotation angles θ1 and θ2 as the drum 124 rotates in a clockwise direction from the stationary state. H denotes a horizontal line passing through a center C of the drum 124, and V denotes a vertical line the reference point is positioned thereon in the stationary state of the drum 124.

The laundry amount has a distribution according to a state of the clothes introduced to the drum 124. The clothes introduced to the drum 124 are placed in the drum 124 to one side thereof, and particularly, placed in the drum 124 gathered to a front side thereof having the laundry introduction opening 111*a* frequently, rather than placed in the drum 124 deep in a rear side of the drum 124. If the drum 124 is accelerated from such a state directly and the current is sensed at the current sensing section, a load larger than an actual load is applied to the motor 113 due to factors, such as eccentricity of the clothes, and friction force acting between the clothes and the door 112, making the present current value sensed at this time to fail to reflect an accurate laundry amount, consequently. In order to solve such a problem, in a method for controlling a laundry treating apparatus in accordance with an example embodiment, after changing a state of the clothes in the drum 124 by rotating the drum 124 at the first speed ω1 for a preset time period, the drum is accelerated to the second speed ω again, the present current value is sensed at this time, and the laundry amount is determined based on the present current value sensed at the time.

The acceleration of the drum 124 to the second speed ω2 (a second speed acceleration operation) may be repeated as many as a set number of times (A11, A12), and the laundry amount may be determined based on the present current values sensed at the current sensing sections (A81, A82, A83, A84, A85) during the drum 124 is being accelerated. The embodiment may repeat the acceleration of the drum 124 to the second speed ω for, but not limited to, 5 times.

The laundry amount calculation unit 239 may obtain a difference between a first current integral Iint1 which is integration of the present current value Iq1 sensed at the first current sensing section (A61) and a second current integral Iint2 which is integration of the present current value Iq2 sensed at the second current sensing section A91 as shown in a first equation below.

$$Idiff = Iint1 - Iint2 = \int_{t(\theta 1)}^{t(\theta 2)} Iq\, dt - \int_{t(\theta 2)}^{t(\theta 3)} Iq\, dt$$

The operation for accelerating the drum 124 to the second speed ω2 may be performed repeatedly, the first present current values are obtained at the first current sensing sections (A81, A82, A83, A84, A85) during the second speed ω2 acceleration respectively, and the second present current value is obtained at a section after the first current sensing sections during the second speed ω2 acceleration. The second current sensing section is a section from the second rotation angle θ2 to the third rotation angle θ3 (A91, A92, A93, A94, A95).

An upper limit of the second current sensing section (i.e., a largest angle) does not exceed 90°, and the second current sensing section may be determined within a range in which the clothes are rotated stuck to the drum 124.

The differences of the current integrals (a difference between the first present current value and the second present current value) obtained in the second speed ω2 acceleration are called as Idiff(1), Idiff(2), Idiff(3), Idiff (4), Idiff(5), respectively.

The laundry amount calculation unit 239 may determine the laundry amount based on the first present current value sensed at the first current sensing section and the second present current value sensed at the second current sensing section. The laundry amount may be determined based on the difference between the first present current value and the second present current value.

The laundry amount calculation unit 239 may determine the laundry amount LD based on a difference between the first current integral value Iint1 at the first current sensing section and the second integral value Iint2 at the second current sensing section.

Depending on embodiments, the laundry amount LD may be obtained by summing the differences Icliff of the current integrals. Weighted values Ki may be given to the current integrals, and a second equation shown below may be an example of such methods.

$$LD = \sum_{i=1}^{m} Ki \left| Idiff(i) \right.$$

Where m denotes a number of repetition times of the second speed ω2 acceleration.

The closer to an average of the differences of the current integrals, the larger weighted value Ki may be given to the difference of the current integrals.

Figure 8:
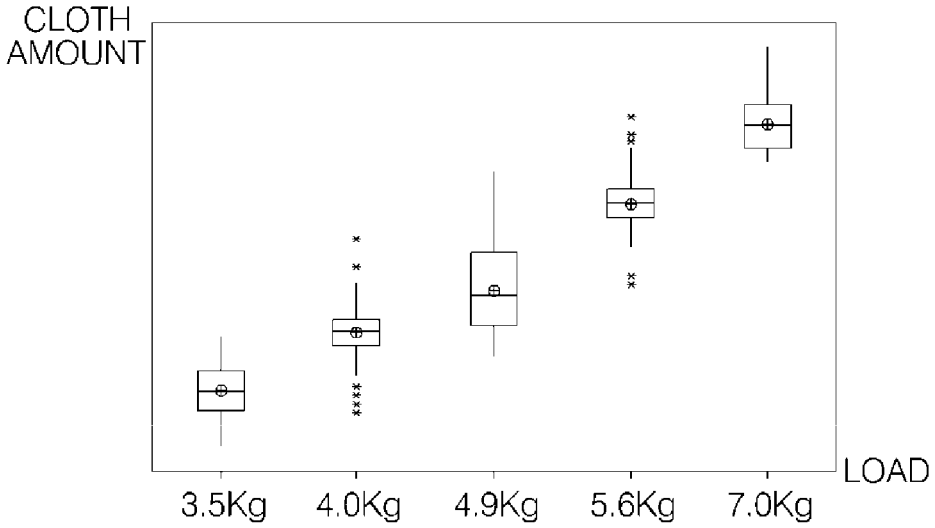
FIG. 8A is a graph illustrating a laundry amount (y-axis) determined based on a current sensed between a rotation angle θ1 and θ2 of a drum versus weight (x-axis) of clothes introduced to the drum.
FIG. 8B is a graph illustrating the laundry amount in FIG. 8A corrected by reflecting an eccentricity correction current sensed between the rotation angle θ1 and θ2 of the drum versus the weight (x-axis) of the clothes introduced to the drum.
Figure 8:
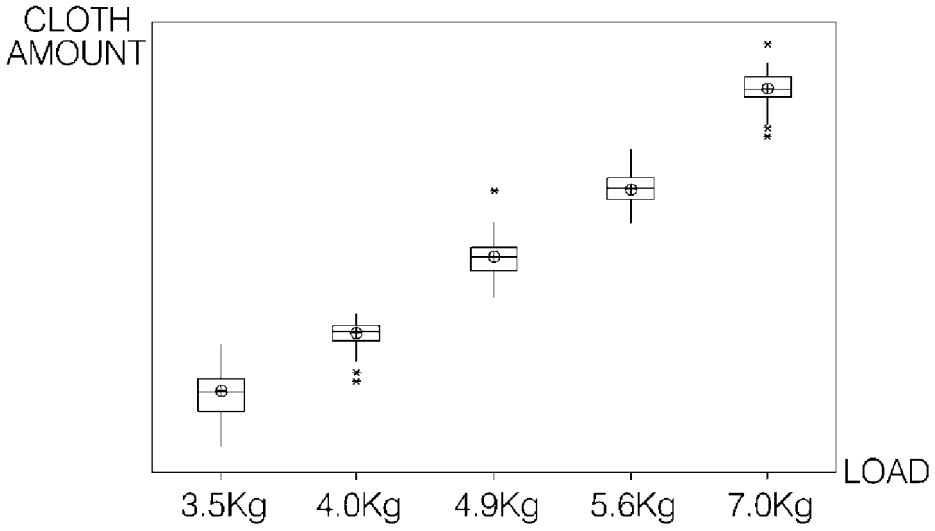

Referring to FIGS. 7 to 8, it can be known that an example (FIG. 8A) may become a more reliable index owing to a small distribution, in which the laundry amount information is corrected by using the current value (UB correction information) obtained at the second current sensing section, than an example (FIG. 8B) in which the laundry amount is determined by using only the current value (Clothes information) obtained at the first current sensing section. As a reference, the angle counter in FIG. 7 illustrates a rotation angle counter counting according to an output voltage of a hall element.

Figure 9:
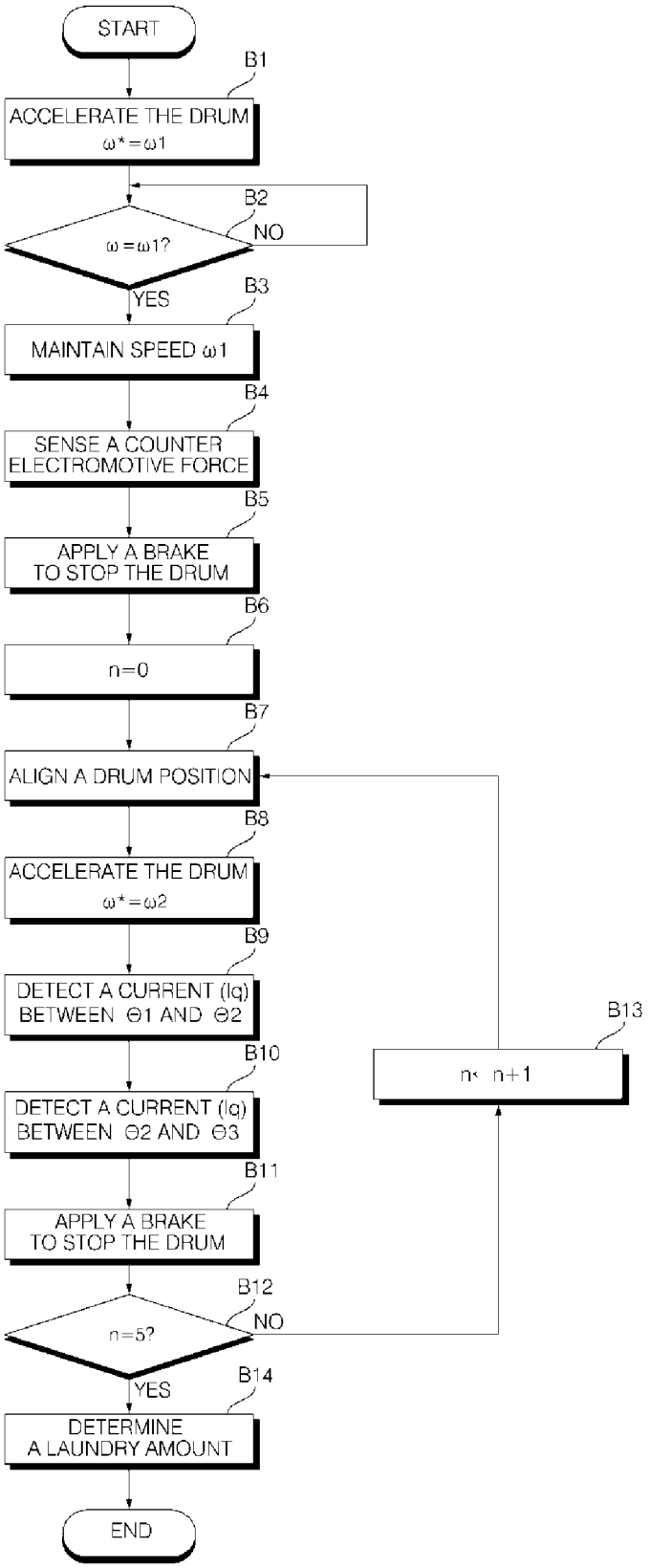
FIG. 9 is a flow chart of a method for controlling a laundry treating apparatus in accordance with an example embodiment.
Figure 10:
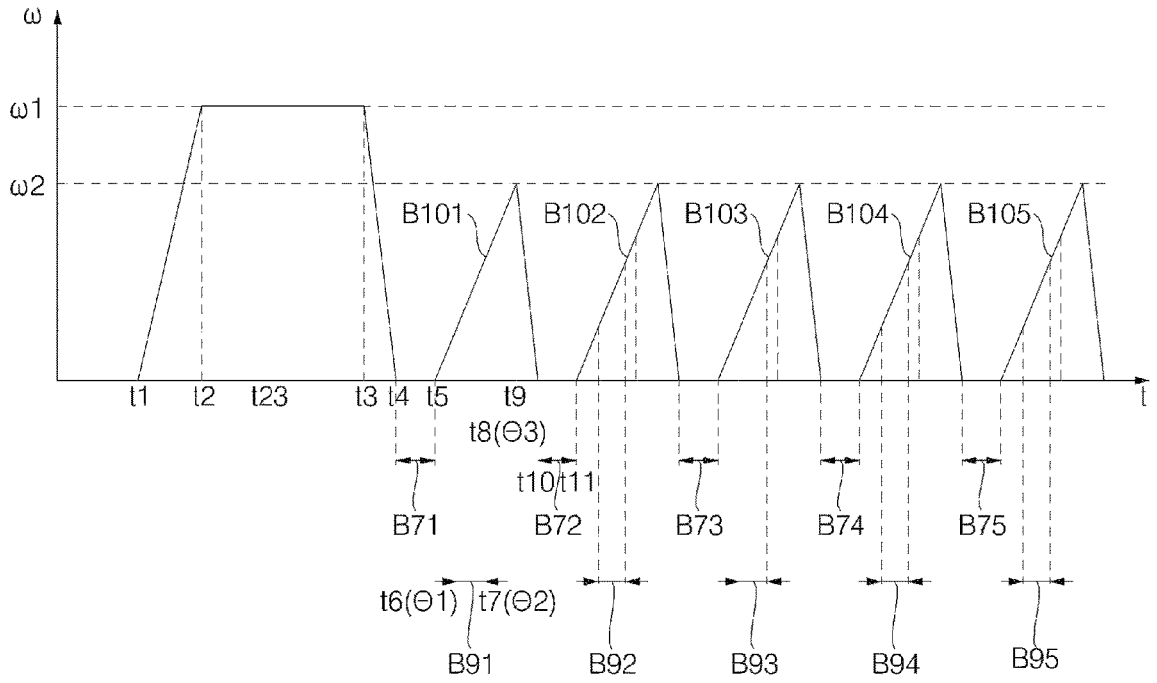
FIG. 10 is a graph illustrating time vs. rotation speed of a drum when a laundry treating apparatus is operated according to a control method in accordance with an example embodiment.

FIG. 9 is a flow chart illustrating a method for controlling a laundry treating apparatus in accordance with an example embodiment. FIG. 10 is a graph illustrating time vs. rotation speed of a drum when a laundry treating apparatus is operated according to a control method in accordance with an example embodiment. A method for controlling a laundry treating apparatus in accordance with an example embodiment will be described with reference to FIGS. 9 to 10. Other embodiments and configurations may also be provided.

The clothes are introduced to the drum 124 and the drum 124 is accelerated (B1, [t1, t2]). A command speed ω* applied to a speed control unit 233 is a first speed ω1, and a rotation speed co of the drum 124 may rise (or increase) following the first speed ω1. The first speed ω1 is a speed that can change a clothes state in the drum 124, required to make at least some of the clothes held in the drum 124 to move, and may be set, for an example, between 46 rpm to 60 rpm.

If the rotation speed co of the drum 124 detected at a position detection unit 231 reaches the first speed ω1 (B2), the speed control unit 233 controls the drum 124 to rotate at a fixed speed of the first speed ω1 (B3, [t2, t3]) by a proportional integral control (PI).

The counter electromotive force of the motor 113 is measured while the drum 124 rotates at the first speed ω1 (B4). A circuit that drives the motor 113 may be expressed with a third equation shown below.

$$Vin = Leq\left|\frac{dI}{dt} + I\right|Req + Vemf$$

Where Vin denotes a voltage applied to the motor 113 from the inverter 250, I denotes a current applied to the motor 113, and Vemf denotes a counter electromotive force of the motor 113. Leq denotes equivalent inductance of the motor 113, and Req denotes equivalent resistance of the motor 113, which are values obtainable by tests in advance.

In an operation in which the rotation speed ω of the drum 124 is controlled by the motor control unit 230 to follow the command speed ω1, the laundry amount sensing unit 239 may obtain the counter electromotive force Vemf based on the voltage value Vin from the inverter 250 and the present current value sensed at the current sensing unit 260. Depending on embodiments, a counter electromotive force sensor may be provided for sensing the counter electromotive force.

The counter electromotive force may be measured after the stator 113*a* or the rotor 113*b* is magnetized. The embodiment may measure the counter electromotive force at a [t23, t3] section which is a time period after a predetermined time period is passed from a time point t2 when the rotation speed of the drum 124 reaches the first speed ω1. Moreover, since the counter electromotive force is affected by the current value applied to the motor 113, a more accurate counter electromotive force may be obtained only when measured at a time point when speed variation of the motor 113 becomes small owing to inertia of the motor 113, which becomes large adequately, to make variation of the counter electromotive force to become slow adequately in comparison to response of the current control unit 235, i.e., after (After t23) the drum 124 is rotated for a predetermined time period at the first speed ω1.

If a certain time period is passed from the t2 to reach the t3, the brake applied to the motor 113, to stop the drum 124 (B5, [t3, t4]). A braking system of the drum 124 may be regenerative braking or dynamic braking. For counting a number of repetitions of a current detection (B9, B10) to be described later, an 'n' is set to zero (B6).

At a position aligning section [t4, t5] before the drum 124 stopped thus is accelerated again, a position of the drum 124 may be aligned (B7, B71). Magnetization of a stator 113*a* can be made to make a rotor 113*b* to be at a regular position, when a d-axis current may output from a current control unit 235, mostly. In this operation, resistance of the motor 113 and an error of voltage information may be detected. The position alignment of the drum 124 may also be performed at a section between acceleration to a second speed ω2 to be described later is repeated (B72, B73, B74, B75).

The drum 124 may accelerate from a stationary state (B8, [t5, t9]). The command speed ω* applied to the speed control unit 233 is a second speed ω2, and the rotation speed ω of the drum 124 rises (or increases) following the second speed ω2. The second speed ω2 may be set less than the first speed ω1 of 46 rpm, for example.

While the drum 124 is being accelerated, the present current Id/Iq is measured (B9) at the first current sensing section (B91) in which a position of the drum 124 changes from a first rotation angle θ1 to a second rotation angle θ2, and the second present current Id/Iq is sensed at the second current sensing section after the first current sensing section (B10). The second current sensing section is a section from the second rotation angle θ2 to the third rotation angle θ3.

An upper limit of the second current sensing section (i.e., a largest angle) may not exceed 90°, and the second current sensing section may be determined within a range in which the clothes are rotated stuck to the drum 124.

As described before, the laundry amount may be determined based on the q-axis present current value Iq of the present current values. Thereafter, the brake applied to stop the drum 124 (B11, [t9, t10]), and the operation again returns to B7.

The acceleration of the drum 124 to the second speed ω2 may be repeated as many as a number of set times (B12, B13), the first present current values may be obtained at first current sensing sections (B91, B92, B93, B94, B95) respectively during acceleration of the drum 124, and the second present current values may be obtained at second current sensing sections (A101, A102, A103, A104, A105) respectively during the second speed ω2 acceleration is made. The embodiment may repeat the acceleration of the drum 124 to the second speed ω2 for, but not limited to, five times.

Alike the foregoing embodiment, the laundry amount calculation unit 239 may determine the laundry amount based on the first present current sensed at the first current sensing section and the second present current obtained at the second current sensing section. The laundry amount may be determined based on a difference of the first present current and the second present current.

The embodiment suggests using, not only a difference of the current integrals Idiff obtained during the acceleration to the second speed ω2, but also the counter electromotive force Vemf sensed when the drum 124 is controlled at the first speed ω1, for determining the laundry amount.

The torque generated by the motor 113 is proportional to the counter electromotive force Vemf and the present current value I. The embodiment suggests determining the laundry amount taking the counter electromotive force Vemf sensed at a section the drum 124 is controlled to rotate at a fixed speed, and the difference of the current integrals at a section the drum 124 is accelerated, as factors.

According to description up to now, an equation for obtaining the laundry amount may be expressed as shown below with a fourth equation.

$$LD = Vemf \sum_{i=1}^{m} Ki \left| Idiff(i) \right|$$

Where m denotes a number of repeating times of the acceleration to the second speed ω2.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A method for controlling a laundry treating apparatus having a drum rotatably provided to hold laundry, a motor to rotate the drum, a motor control unit to control operations of start, accelerate and stop of the motor, a current sensing unit to sense a current applied to the motor, and a laundry amount sensing unit to determine a laundry amount based on a current value sensed at the current sensing unit, the method comprising:

controlling the drum to accelerate the drum to rotate at a first speed;

sensing a counter electromotive force of the motor while the drum is rotated at the first speed;

applying a brake to stop the drum from rotating at the first speed;

after stopping the drum, accelerating the drum to a second speed;

sensing a current applied to the motor at a first current sensing section between a first rotation angle and a second rotation angle while the drum is accelerating to the second speed;

sensing the current applied to the motor at a second current sensing section after the first current sensing section while the drum is accelerating to the second speed; and determining a laundry amount based on a difference between an integral of the sensed current at the first current sensing section and an integral of the sensed current at the second current sensing section.

2. The method of claim 1, wherein in the sensing of the current at the first current sensing section and in the sensing of the current at the second current sensing section, a q-axis current applied to the motor with reference to a d-q axes rotating coordinate system is measured, wherein the d-q axes and the coordinate system are associated with the sensed counter electromotive force.

3. The method of claim 1, wherein the first rotation angle is greater than zero.

4. The method of claim 1, wherein sensing the current at the second current sensing section includes sensing the current applied to the motor between the second rotation angle and a third rotation angle.

5. The method of claim 1, wherein the second speed is less than the first speed.

6. The method of claim 1, wherein accelerating the drum to the second speed is performed repeatedly, and wherein determining the laundry amount includes determining the laundry amount based on difference of the sensed currents at the first current sensing section and the sensed currents at the second current sensing section, which are repeatedly obtained during the accelerating of the drum.

7. The method of claim 1, wherein determining the laundry amount includes determining the laundry amount based on the sensed current at the first current sensing section, the sensed current at the second current sensing section, and the counter electromotive force.

8. The method of claim 7, wherein sensing the counter electromotive force includes sensing the counter electromotive force while the drum is rotated at the first speed for a predetermined time period.

9. A laundry treating apparatus comprising:

a drum rotatably provided to hold laundry;

a motor to rotate the drum;

a motor control unit to apply a brake to stop the drum after rotating the drum at a first speed, and the motor control unit to accelerate the motor such that the drum rotates at a second speed;

a current sensing unit to sense a current applied to the motor while the motor is controlled by the motor control unit; and a laundry amount sensing unit to detect a counter electromotive force of the motor based on the sensed current at the current sensing unit while the drum is rotated at the first speed, the laundry amount sensing unit to determine a laundry amount based on a difference between a sensed current at a first current sensing section between a first rotation angle and a second rotation angle while the drum is accelerating to rotate at the second speed, and a sensed current at a second current sensing section after the first current sensing section, wherein the laundry amount is determined based on a difference between an integral of the sensed current at the first current sensing section and an integral of the sensed current at the second current sensing section.

10. The laundry treating apparatus of claim 9, wherein the current sensing unit measures a q-axis current applied to the motor with reference to a d-q axes rotating coordinate system, and the laundry amount sensing unit determines the laundry amount based on the q-axis current, wherein the d-q axes and the coordinate system are associated with the sensed counter electromotive force.

11. The laundry treating apparatus of claim 10, wherein the laundry amount is determined based on an integral of the q-axis current sensed at the first current sensing section and an integral of the q-axis current sensed at the second current sensing section.

12. The laundry treating apparatus of claim 10, wherein the laundry amount is determined based on an integral of the q-axis current when the drum changes from the first rotation angle to the second rotation angle.

13. The laundry treating apparatus of claim 9, wherein the first rotation angle is greater than zero.

14. The laundry treating apparatus of claim 9, wherein the second speed is less than the first speed.

15. The laundry treating apparatus of claim 9, wherein the sensed current at the second current sensing section is obtained by sensing the current applied to the motor between the second rotation angle and a third rotation angle.

16. The laundry treating apparatus of claim 9, wherein the motor control unit repeatedly accelerates the drum to the second speed, and the laundry amount is determined based on differences of the sensed currents at the first current sensing section and the sensed currents at the second current sensing section, which are respectively obtained while the drum is repeatedly accelerated to the second speed.

17. The laundry treating apparatus of claim 9, wherein the laundry amount sensing unit determines the laundry amount based on the sensed current at the first current sensing section, the sensed current at the second current sensing section, and the counter electromotive force.

18. The laundry treating apparatus of claim 17, wherein the counter electromotive force is sensed while the drum is rotated at the first speed for a predetermined time period.

* * * * *